US009333623B2

(12) United States Patent
Pillhoefer et al.

(10) Patent No.: US 9,333,623 B2
(45) Date of Patent: May 10, 2016

(54) METHOD AND DEVICE FOR REMOVING A LAYER FROM A SURFACE OF A BODY

(75) Inventors: Horst Pillhoefer, Roehrmoos (DE); Johann Oettl, Altomuenster (DE); Markus Niedermeier, Munich (DE); Thomas Cosack, Windach (DE); Dirk Ruhlig, Dorfen (DE)

(73) Assignee: MTU Aero Engines GmbH, Munich (DE)

( * ) Notice: Subject to any disclaimer, the term of this patent is extended or adjusted under 35 U.S.C. 154(b) by 415 days.

(21) Appl. No.: 13/816,910

(22) PCT Filed: Aug. 6, 2011

(86) PCT No.: PCT/DE2011/001562
§ 371 (c)(1), (2), (4) Date: Feb. 13, 2013

(87) PCT Pub. No.: WO2012/022298
PCT Pub. Date: Feb. 23, 2012

(65) Prior Publication Data

US 2013/0139852 A1 Jun. 6, 2013

(30) Foreign Application Priority Data

Aug. 14, 2010 (DE) ..... 10 2010 034 336

(51) Int. Cl.

| | |
|---|---|
| ***B24C 1/00*** | (2006.01) |
| ***B08B 7/00*** | (2006.01) |
| ***B24C 1/08*** | (2006.01) |
| ***B24C 1/10*** | (2006.01) |
| ***B24C 11/00*** | (2006.01) |
| ***B24C 3/00*** | (2006.01) |

(52) U.S. Cl.
CPC ... *B24C 1/00* (2013.01); *B08B 7/00* (2013.01); *B24C 1/086* (2013.01); *B24C 1/10* (2013.01); *B24C 3/00* (2013.01); *B24C 11/00* (2013.01); *B24C 11/005* (2013.01)

(58) Field of Classification Search
CPC ..... B23C 1/00; B23C 3/00; B08B 7/00; B08B 7/04; B24C 1/00; B24C 1/086
USPC ..... 134/6, 7, 42; 451/38, 39, 75
See application file for complete search history.

(56) References Cited

U.S. PATENT DOCUMENTS

| | | | | |
|---|---|---|---|---|
| 4,239,804 | A * | 12/1980 | Van Kuiken, Jr. | 428/409 |
| 4,889,589 | A | 12/1989 | McComas | |
| 5,972,424 | A | 10/1999 | Draghi et al. | |
| 2009/0302004 | A1 | 12/2009 | Manier et al. | |

FOREIGN PATENT DOCUMENTS

| | | | |
|---|---|---|---|
| DE | 41 10 595 | C1 | 11/1992 |
| DE | 43 03 137 | C2 | 8/1994 |
| DE | 10 2005 049 249 | A1 | 4/2007 |
| DE | 10 2008 014 726 | A1 | 9/2009 |
| EP | 0 492 323 | A2 | 7/1992 |
| EP | 0492323 | * | 7/1992 |
| EP | 1 317 995 | A1 | 6/2003 |
| WO | WO 91/13191 | A1 | 9/1991 |
| WO | WO 00/23201 | A1 | 4/2000 |
| WO | WO-2009/050251 | * | 4/2009 |
| WO | WO 2009/050251 | A2 | 4/2009 |

OTHER PUBLICATIONS

PCT/DE2011/001562, PCT/ISA/210, dated Jun. 6, 2012, 2 pages.
German Search Report, dated Oct. 12, 2011, 4 pages.

* cited by examiner

*Primary Examiner* — Saeed T Chaudhry
(74) *Attorney, Agent, or Firm* — Crowell & Moring LLP

(57) ABSTRACT

A method for removing a layer made of a first material from a surface of a body made of a second material is disclosed. The body is subjected to a pressurized jet containing a blasting medium composed of particles, where the pressurized jet at least intermittently has an Almen intensity of at most 0.35 Almen A, preferably at most 0.3 Almen A and particularly preferably at most 0.25 Almen A.

14 Claims, No Drawings

METHOD AND DEVICE FOR REMOVING A LAYER FROM A SURFACE OF A BODY

This application claims the priority of International Application No. PCT/DE2011/001562, filed Aug. 6, 2011, and German Patent Document No. 10 2010 034 336.6, filed Aug. 14, 2010, the disclosures of which are expressly incorporated by reference herein.

BACKGROUND AND SUMMARY OF THE INVENTION

The invention relates to a method and a device for removing a layer made of at least one first material from a surface of a body made of at least one second material. Examples of such bodies are structural elements of machines or equipment whose surface is frequently provided with a coating made of another material, such as, for example, a lacquer or a similar protective coat. A particularly preferred use relates to structural elements of aircraft engines, in particular components, for instance, profiles subject to flow such as, for example, rotor blades or guide blades or arrays. Examples of these types of layers are, in particular, thermal barrier coatings or ceramic layers, for example, coatings containing $ZrO_2$ or $Al_2O_3$, especially defective coatings on structural elements that are newly manufactured or that need to be repaired.

Normally, grinding methods have been used until now for this, in which a grinding material is used to process the surface manually or with the aid of a grinding machine. In the case of other methods, chemical cleaning or caustic agents are used to corrode and strip off the to-be-removed layer. In particular, thermal barrier coatings or ceramic layers are frequently removed by means of high-pressure water jets, especially also in combination with KOH lye. These types of methods are frequently quite expensive, the use of which is associated with expensive equipment or with an undesired change to the adhesive layer.

A method for the shot-peening treatment of integrally bladed rotors is known from the pre-characterizing clause of Claim 1 of German Patent Document No. DE 10 2008 014 726 A1. However, this might result at the same time in damage to the adhesive layer, i.e., the surface layer to which the to-be-removed layer is adhered; or to the body made of the second material, i.e., the base material.

The object of the present invention is to improve the removal of a layer from a surface of a body.

DETAILED DESCRIPTION OF THE INVENTION

The invention provides for subjecting the body whose surface is supposed to be freed of a layer to a pressurized jet of at least one blasting medium, especially spherical particles, wherein the pressurized jet has an Almen intensity during the entire exposure time or at least during a portion of this time which is at most 0.35 Almen A, preferably at most 0.3 Almen A and particularly preferably at most 0.25 Almen A.

Therefore, the invention proposes a low-energy fatigue blasting over the known prior art, in particular for removing thermal barrier coatings and/or ceramic layers, for components of an aircraft engine such as guide vane and rotor assemblies, in particular of a turbine or turbine stage. The method may be used in equal measure for repairing these types of components as well as for removing coatings in the case of new manufacturing.

It is preferred that the Almen intensity of the pressurized jet during the entire exposure time or at least during a portion of this time be at least 0.005 Almen N, preferably at least 0.01 Almen N and particularly preferably at least 0.05 Almen N.

The Almen intensity is a quantitative measure of blasting processes, in particular shot-peening processes. In this case, the deformation that the blasting process produces in a specimen, in particular a strip made of SAE1070 spring steel ("Almen strip") during blasting from 90 mm, in particular the deflection as a consequence of the residual compressive stress impressed on the specimen that is blasted on one side during the blasting process, in particular the (maximum) arch height of the Almen strip, is determined. In the process, the specimen may be blasted for a defined time or until the saturation point is reached. This is defined as the deflection which increases by only 10% when doubling the blasting duration. The deformation may be related to the wall strength of the Almen strip that is used. This is approx. 0.79 mm (0.031") for N and approx. 1.29 mm (0.051") for A.

The first material may also be identical to the second material in whole or in part, in particular chemically or physically. The particles are preferably spherical, but in this case do not have to be exactly ball-shaped; an approximately spherical shape of the particles also suffices.

In the process, the body is preferably subjected to the pressurized jet only until the to-be-removed layer has been removed to a desired degree. In the case of another embodiment of the invention, the body is also still subjected to the pressurized jet when the to-be-removed layer has been removed to the desired degree so long until the surface of the body has reached a desired predetermined degree of strength at the locations at which said surface was subject to the pressurized jet. This embodiment of the invention is associated with the advantage that the cleaning of a surface or the removal of a layer from a surface may be combined with a strengthening treatment of the surface in one work step. When blasting a surface with shot peening, it is possible specifically to bring about residual compressive stress in the surface, thereby improving the fatigue strength of the surface material. In this way, it is possible to decisively reduce crack formation, e.g., from corrosion fatigue in the surface.

The in particular spherical particles are preferably made—during the duration of the blasting at least intermittently—of a material that is less chemically reactive ("inert"). In addition, or as an alternative, the size of the particles, the material composition and/or the internal structure of the particles may change with the duration of the blasting. In particular, in the transition from the cleaning effect of the blasting that removes the coating to the hardening effect of the blasting, a change in the size of the particles, the material composition thereof or the internal structure thereof may have an advantageous effect on the result of the blasting.

In the process, it is preferred that particles be used at least intermittently which contain especially a spherical core made of a second material, said core being sheathed concentrically with a first material. A preferred embodiment of the method according to the invention provides that the pressurized jet contain, in addition to a blasting medium composed of particles which are preferably made of a material that is less chemically reactive, at least intermittently still at least one other substance which reacts chemically with at least one material component of the to-be-removed layer. These chemically reactive materials are preferably lyes made of an alkali hydroxide, for example potassium hydroxide (KOH).

Investigations have shown that glass beads or particles sheathed in glass are especially suitable as a blasting medium. In addition, or as an alternative, some or all of the particles may also comprise zirconium (Zr), ceramic and/or synthetic material, in particular be made hereof.

It has been shown that particles whose maximum or average dimensions, in particular the diameter thereof, are at least 5 μm, preferably at least 10 μm and particularly preferably at least 15 μm and/or at most 550 μm, preferably at most 500 μm and particularly preferably at most 450 μm, produce advantageous results in terms of the surface quality in the case of at least intermittent use.

The coverage rate in the case of a blasting using the method according to the invention is preferably between 3 and 100.

Some or all particles have at least intermittently preferably a hardness between 280 and 550 hardness degrees according to Vickers (HV), with a test force of 0.3 kilopond. In addition or as an alternative, the breaking elongation $\epsilon$ thereof is preferably at most 0.3%, preferably at most 0.2% and particularly preferably at most 0.1%. The average speed of the particles in the pressurized jet is preferably at least 0.5 m/s, preferably at least 1 m/s and particularly preferably at least 20 m/s, and/or at most 80 m/s.

The invention claimed is:

1. A method for removing a layer made of at least one first material from a surface of a body made of at least one second material, comprising the steps of:

blasting the body with a pressurized jet containing at least one blasting medium composed of spherical particles and, in addition to the spherical particles, it contains, at least intermittently an alkali hydroxide lye that reacts chemically with the at least one first material of the layer; and ending blasting the body with the pressurized jet once the layer has been removed to a desired degree or the surface of the body has reached a desired predetermined degree of strength at a location at which the body was blasted by the pressurized jet.

2. The method according to claim 1, wherein the pressurized jet at least intermittently has an Almen intensity of 0.3 Almen A.

3. The method according to claim 1, wherein the pressurized jet at least intermittently has an Almen intensity of 0.25 Almen A.

4. The method according to claim 1, wherein the pressurized jet at least intermittently has an Almen intensity of at least 0.005 Almen N.

5. The method according to claim 1, wherein the pressurized jet at least intermittently has an Almen intensity of at least 0.01 Almen N.

6. The method according to claim 1, wherein the pressurized jet at least intermittently has an Almen intensity of at least 0.05 Almen N.

7. The method according to claim 1, wherein the spherical particles include glass, zirconium, ceramic and/or synthetic material.

8. The method according to claim 1, wherein the spherical particles contain a core made of a third material and wherein the core is sheathed concentrically with a fourth material.

9. The method according to claim 1, wherein the spherical particles are made of a material that is less chemically reactive than the alkali hydroxide lye.

10. The method according to claim 1, wherein the spherical particles have a maximum or average outer diameter which is at least 5 μm and/or at most 550 μm.

11. The method according to claim 1, wherein the spherical particles have a hardness between 280 and 550 hardness degrees according to Vickers (HV).

12. The method according to claim 1, wherein a breaking elongation of the spherical particles is at most 0.3%.

13. The method according to claim 1, wherein an average speed of the spherical particles in the pressurized jet is at least 20 m/s and/or at most 80 m/s.

14. A method for removing a layer made of at least one first material from a surface of a body made of at least one second material, comprising the steps of:

blasting the body with a pressurized jet containing at least one blasting medium composed of spherical particles, wherein the pressurized jet at least intermittently has an Almen intensity of at most 0.35 Almen A;

wherein the pressurized jet contains, in addition to the spherical particles, at least intermittently at least one other substance which reacts chemically with the at least one first material of the layer, wherein the spherical particles are made of a material that is less chemically reactive than the at least one other substance; and wherein the at least one other substance is an alkali hydroxide lye.

* * * * *